US011168692B2

(12) United States Patent
Huang et al.

(10) Patent No.: US 11,168,692 B2
(45) Date of Patent: Nov. 9, 2021

(54) COMPRESSOR WITH EXHAUST STRUCTURE HAVING MULTIPLE ROTATING PLATES EACH CONTAINING EXHAUST PORTS WITH CORRESPONDING EXHAUST VALVES

(71) Applicant: GREE GREEN REFRIGERATION TECHNOLOGY CENTER CO., LTD. OF ZHUHAI, Zhuhai (CN)

(72) Inventors: Hui Huang, Zhuhai (CN); Pengkai Wan, Zhuhai (CN); Yusheng Hu, Zhuhai (CN); Jia Xu, Zhuhai (CN); Liping Ren, Zhuhai (CN); Fayou Luo, Zhuhai (CN); Fei Wu, Zhuhai (CN)

(73) Assignee: GREE GRFEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 177 days.

(21) Appl. No.: 16/335,246

(22) PCT Filed: Sep. 28, 2017

(86) PCT No.: PCT/CN2017/103889
§ 371 (c)(1),
(2) Date: Mar. 20, 2019

(87) PCT Pub. No.: WO2018/072606
PCT Pub. Date: Apr. 26, 2018

(65) Prior Publication Data

US 2020/0018314 A1 Jan. 16, 2020

(30) Foreign Application Priority Data

Oct. 17, 2016 (CN) ..... 201610905871.7

(51) Int. Cl.
*F04C 29/12* (2006.01)
*F04C 29/00* (2006.01)
*F04C 18/344* (2006.01)

(52) U.S. Cl.
CPC ..... *F04C 29/12* (2013.01); *F04C 29/00* (2013.01); *F04C 18/3441* (2013.01); *F04C 29/128* (2013.01); *F04C 2240/80* (2013.01)

(58) Field of Classification Search
CPC ..... F04C 29/12; F04C 29/00; F04C 29/128; F04C 18/3441; F04C 2240/80
See application file for complete search history.

(56) References Cited

U.S. PATENT DOCUMENTS 3,654,761 A * 4/1972 Eickmann ..... F16H 39/06 60/488
4,231,727 A * 11/1980 Buchholz ..... F04C 18/3441 418/152

(Continued)

FOREIGN PATENT DOCUMENTS

CN 1963213 A 5/2007
CN 102235357 A 11/2011

(Continued)

OTHER PUBLICATIONS

English Machine Translation of CN103982435A (Year: 2014).*

*Primary Examiner* — Mary Davis
*Assistant Examiner* — Paul W Thiede
(74) *Attorney, Agent, or Firm* — Kilpatrick Townsend & Stockton LLP

(57) ABSTRACT

Disclosed is a compressor including a cylinder, an upper flange and a lower flange respectively provided on an upper side and a lower side of the cylinder, and a main shaft having a sliding vane mounting portion. The sliding vane mounting portion of the main shaft is provided with at least two sliding vanes. Two rotary plates are provided. One rotary plate is (Continued)

provided between the sliding vane mounting portion and the upper flange, and another rotary plate is provided between the sliding vane mounting portion and the lower flange. Each of the rotary plates is fixedly connected with the main shaft and provided with exhaust openings in one-to-one correspondence with the exhaust sides of the sliding vanes and exhaust valves configured to control opening/closing of respective exhaust openings. The upper flange and the lower flange are both provided with exhaust passages corresponding to respective exhaust openings of each rotary plate.

6 Claims, 6 Drawing Sheets

(56) References Cited

U.S. PATENT DOCUMENTS 5,170,085 A * 12/1992 Shinto ..... H02K 1/278
310/156.28
5,240,387 A 8/1993 Nobuyuki et al.
5,660,540 A 8/1997 Kang
6,036,450 A * 3/2000 Murayama ..... F04C 28/14
417/295
2013/0064705 A1 3/2013 Shin et al.

FOREIGN PATENT DOCUMENTS

| | | | |
|---|---|---|---|
| CN | 202391736 | U | 8/2012 |
| CN | 103982435 | A | 8/2014 |
| CN | 105201833 | A | 12/2015 |
| CN | 105275815 | A | 1/2016 |
| CN | 105987004 | A | 10/2016 |
| CN | 106438375 | A | 2/2017 |
| CN | 206144797 | U | 5/2017 |
| EP | 2568180 | A1 | 3/2013 |
| EP | 3252313 | A1 | 12/2017 |
| JP | 1995197895 | A | 12/1995 |
| JP | 2005076527 | A | 3/2005 |

* cited by examiner

COMPRESSOR WITH EXHAUST STRUCTURE HAVING MULTIPLE ROTATING PLATES EACH CONTAINING EXHAUST PORTS WITH CORRESPONDING EXHAUST VALVES

CROSS-REFERENCE TO RELATED APPLICATIONS

This application claims the priority of Chinese Patent Application No. 201610905871.7, filed on Oct. 17, 2016, and entitled "Compressor and Exhaust Structure Thereof", the disclosure of which is incorporated herein by reference in its entirety.

TECHNICAL FIELD

The present invention relates to the technical field of compressor, and more particularly, to a compressor.

BACKGROUND

A rotary vane compressor in the prior art generally exhausts at the side of the cylinder or at the side of the flange, that is, an exhaust opening and an exhaust valve plate are arranged in the cylinder or in the flange, and the position of the exhaust opening is fixed.

The main shaft of the rotary vane compressor is provided with a plurality of sliding vanes, each of which is corresponding to one of compression cavities, the exhaust end of each compression cavity can periodically align with the exhaust opening while the main shaft rotating, to complete the gas discharging.

However, the exhaust opening in the prior art may be opened or closed several times in one rotation circle, and the frequent opening and closing may easily cause a problem of fatigue or even fracture of the valve plate which controls the opening and closing of the exhaust opening.

Therefore, it has become an important technical problem to be solved by those skilled in the art that the valve plate of the compressor in the prior art is prone to fatigue damages.

SUMMARY

In view of this, an objective of the present application is to provide a compressor, which can avoid the problem that the valve plate is prone to fatigue damages, and moreover, which can increase the operating frequency of the compressor and the maximum refrigerating capacity of the compressor.

The present application provides a compressor, including a cylinder, an upper flange and a lower flange which are disposed on an upper side and on a lower side of the cylinder respectively, and a main shaft having a sliding vane mounting portion; wherein, the sliding vane mounting portion of the main shaft is provided with at least two sliding vanes; a side of each sliding vane is a gas suction side, and another side of the sliding vane is an exhaust side; a rotary plate is provided between the sliding vane mounting portion and at least one of the upper flange and the lower flange; the rotary plate is fixedly connected with the main shaft; and the rotary plate is provided with exhaust openings which communicate one-to-one with the exhaust side of each of the sliding vanes, and each exhaust opening is provided with an exhaust valve which controls opening and closing of the exhaust opening.

In an embodiment, the sliding vane mounting portion is provided with a vent, which is configured to increase an area of communication between the exhaust side of the sliding vane and the exhaust opening of the rotary plate.

In an embodiment, there is only one rotary plate, which is provided between the upper flange and the sliding vane mounting portion; and exhaust passages are disposed in the upper flange corresponding to respective exhaust openings of the rotary plate.

In an embodiment, there is only one rotary plate, which is provided between the lower flange and the sliding vane mounting portion; and exhaust passages are disposed in the lower flange corresponding to respective exhaust openings of the rotary plate.

In an embodiment, there are two rotary plates; one rotary plate is provided between the upper flange and the sliding vane mounting portion; another rotary plate is provided between the lower flange and the sliding vane mounting portion; and the upper flange and the lower flange are both provided with exhaust passages corresponding to respective exhaust openings of each rotary plate.

In an embodiment, a connecting opening is disposed on the rotary plate at a position corresponding to the sliding vane mounting portion; and the rotary plate is fixed on the sliding vane mounting portion through a connecting member which is inserted and mounted in the connecting opening.

In an embodiment, a sum of cross-sectional areas of all exhaust passages is greater than a sum of cross-sectional areas of all exhaust openings.

In an embodiment, the vent is a chamfered structure, which is disposed at an edge of the sliding vane mounting portion and adjacent to the exhaust side of each sliding vane.

In an embodiment, a chamfered surface of the chamfered structure is a curved surface.

The present application further provides a compressor having the exhaust structure mentioned above.

In the technical solutions provided by the present application, a rotary plate is provided between the sliding vane mounting portion and the upper flange and/or the lower flange; the rotary plate rotates along with the main shaft; the rotary plate is provided with exhaust openings which communicate one-to-one with each of the sliding vanes; the exhaust openings communicate one-to-one with the exhaust side of each sliding vane; an exhaust valve is configured to control opening and closing of each exhaust opening. When the compressor operates, and when the pressure of the refrigerant in the compression cavity reaches the set pressure, the exhaust valve corresponding to the compression cavity opens, and the high-pressure refrigerant is discharged through the exhaust opening. It should be noted that, when the compressor operates, the inner cavity of the cylinder is separated into a plurality of compression cavities and gas suction cavities by a plurality of sliding vanes; the exhaust side of each sliding vane refers to a side of the sliding vane which is located in the compression cavity, and the other side which is located in the gas suction cavity is the gas suction side. In this way, when the main shaft rotates for one cycle, each compression cavity fulfills one exhaust process, and each compression cavity is correspondingly provided with one exhaust opening and one exhaust valve, therefore, each exhaust valve only needs to open and close once when the main shaft rotates for one cycle, thereby avoiding the problem that the exhaust valve is prone to fatigue damages. Moreover, such an exhaust structure can increase the operating frequency of the compressor effectively and increase the maximum refrigerating capacity of the compressor.

DESCRIPTION OF THE DRAWINGS

In order to describe the embodiments of the present invention or the technical solutions in the prior art more clearly, the figures to be used in describing the embodiments or the prior art will be briefly described. Obviously, the figures to be described below are merely embodiments of the present invention. For those skilled in the art, other figures may be obtained according to these figures without any creative work.

in FIGS. 1-5:

Figure 1:
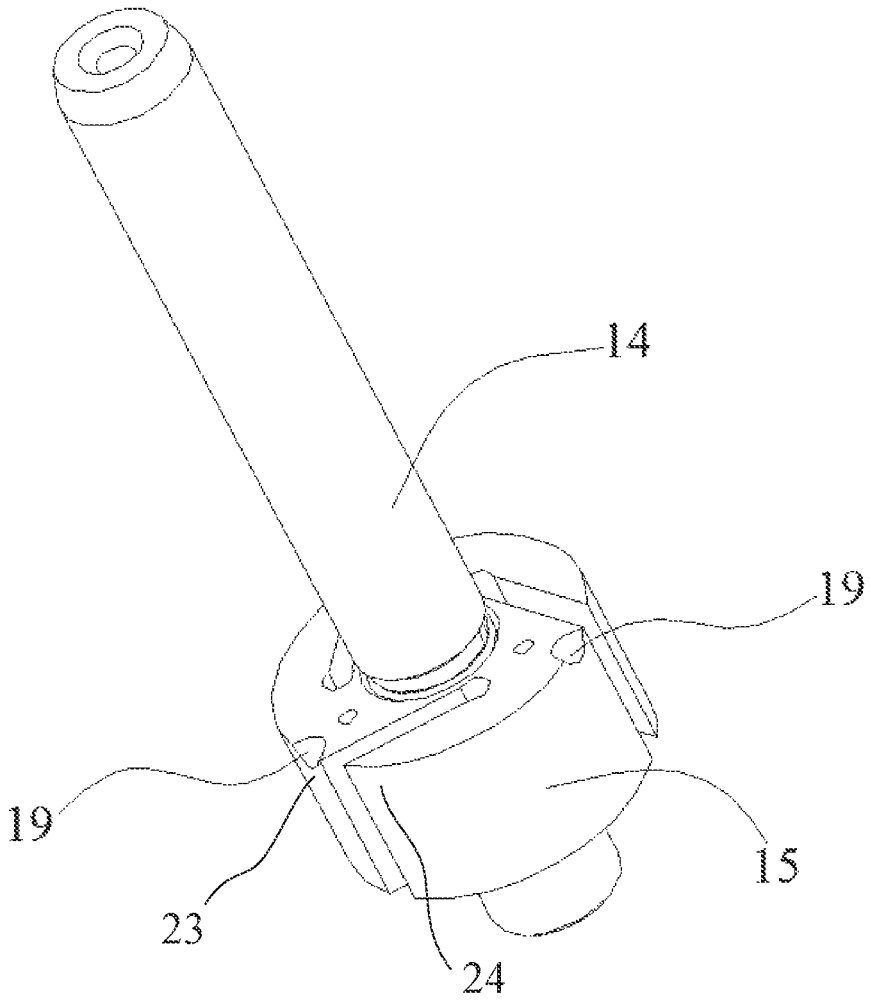
FIG. 1 is a schematic view of the main shaft in an embodiment of the present invention.
Figure 2:
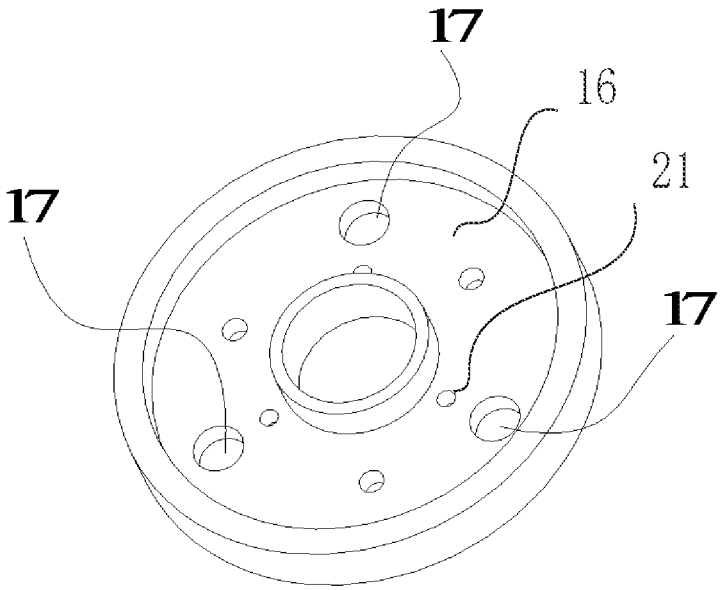
FIG. 2 is a schematic view of the rotary plate in an embodiment of the present invention.

cylinder—11, upper flange—12, lower flange—13, main shaft—14, sliding vane mounting portion—15, rotary plate—16, exhaust opening—17, exhaust valve—18, vent—19, exhaust passage—20, connecting opening—21, connecting member—22, exhaust side of sliding vane—23, gas suction side of the sliding vane—24, sliding vane(s)—25(*s*).

DETAILED DESCRIPTION OF EMBODIMENTS

An objective of the embodiments is to provide an exhaust structure of a compressor, which can avoid the problem that the valve plate is prone to fatigue damages, and moreover, which can increase the operating frequency of the compressor and the maximum refrigerating capacity of the compressor. Another objective of the embodiments is to provide a compressor having the exhaust structure mentioned above.

The embodiments will be described hereinafter with reference to the accompanying figures. Furthermore, the embodiments described below are not intended to limit the contents described in the claims. And the contents described in the following embodiments are not all required for the solutions described in the claims.

As shown in FIGS. 1 to 4, the exhaust structure of the compressor provided by the embodiment includes a cylinder 11, an upper flange 12, a lower flange 13, a main shaft 14 and a rotary plate 16.

Wherein, the main shaft 14 passes through the cylinder 11, and the upper side and lower side of the cylinder 11 are sealed by the upper flange 12 and the lower flange 13 respectively. A sliding vane mounting portion 15 of the main shaft 14 is disposed in the working cavity of the cylinder 11. The sliding vane mounting portion 15 is provided with at least two sliding vanes 25, which separate the working cavity of the cylinder 11 into a compression cavity and a gas suction cavity while the main shaft 14 is rotating. When the refrigerant in the compression cavity is compressed to arrive at a preset pressure, the refrigerant is discharged from the cylinder 11. When the gas refrigerant is discharged, a side of the sliding vane 25 adjacent to the compression cavity is the exhaust side 23, and the other side is the gas suction side 24.

Figure 3:
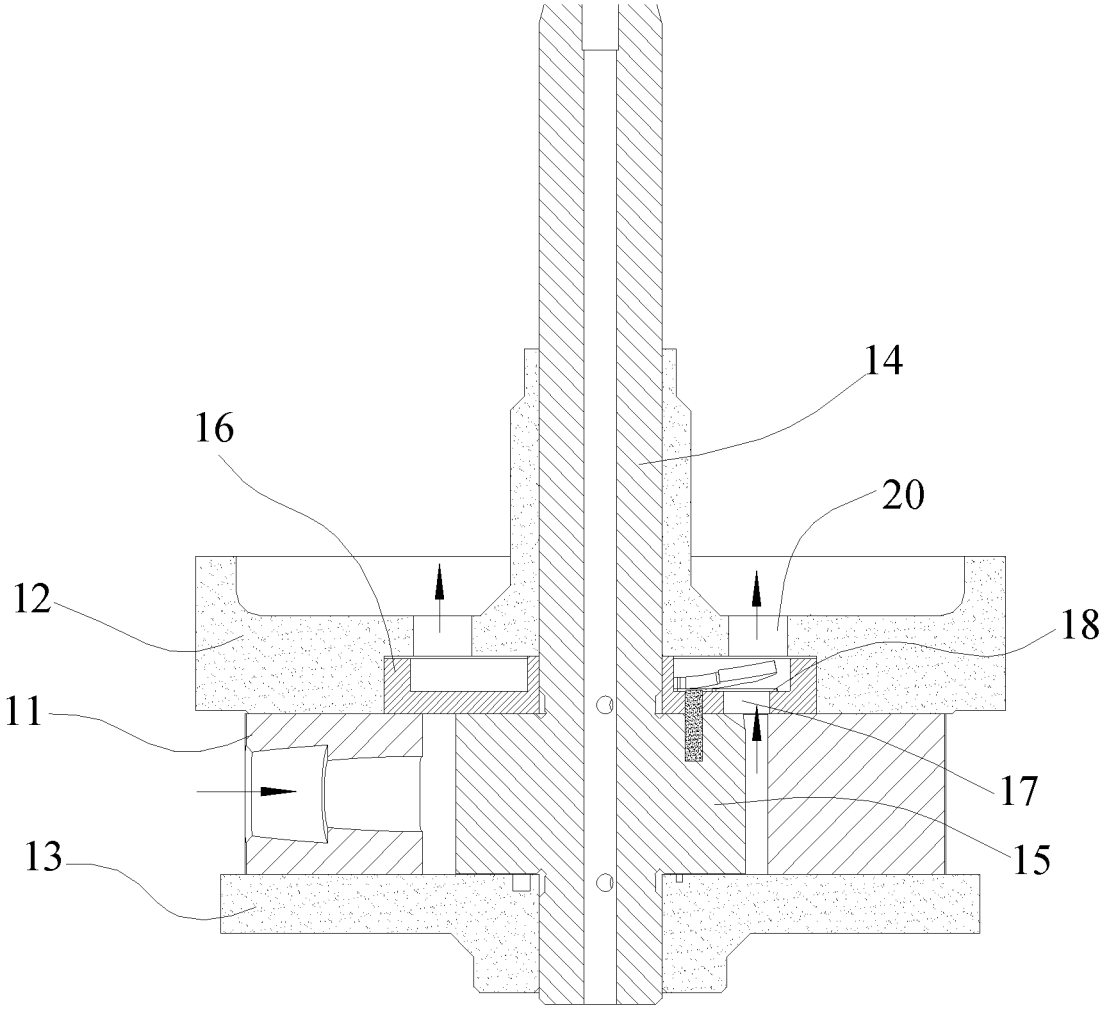
FIG. 3 is a cross-sectional view of the compressor in the first embodiment of the present invention.
Figure 4:
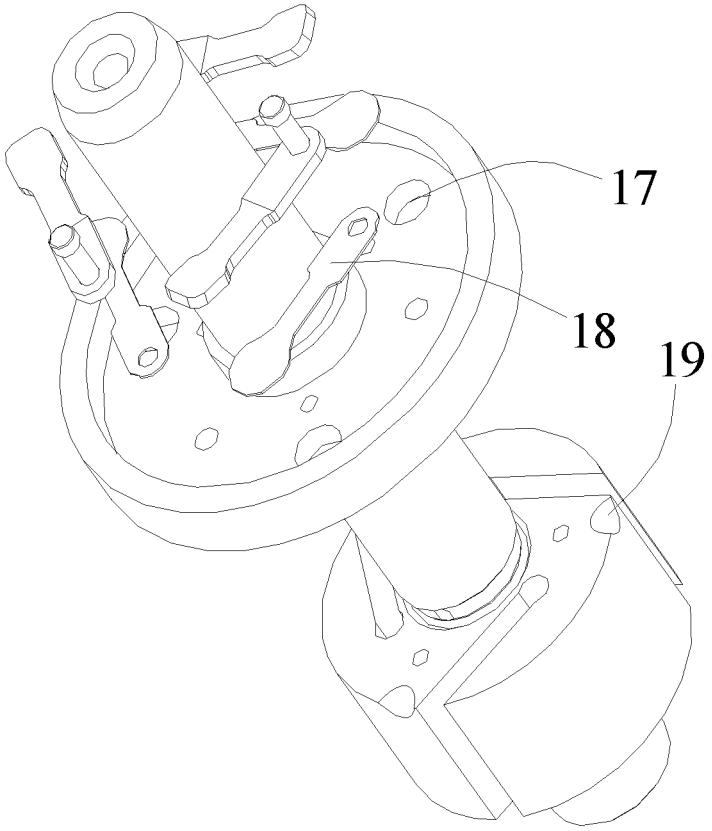
FIG. 4 is an exploded view of the rotary plate and the main shaft in the first embodiment of the present invention.
Figure 5:
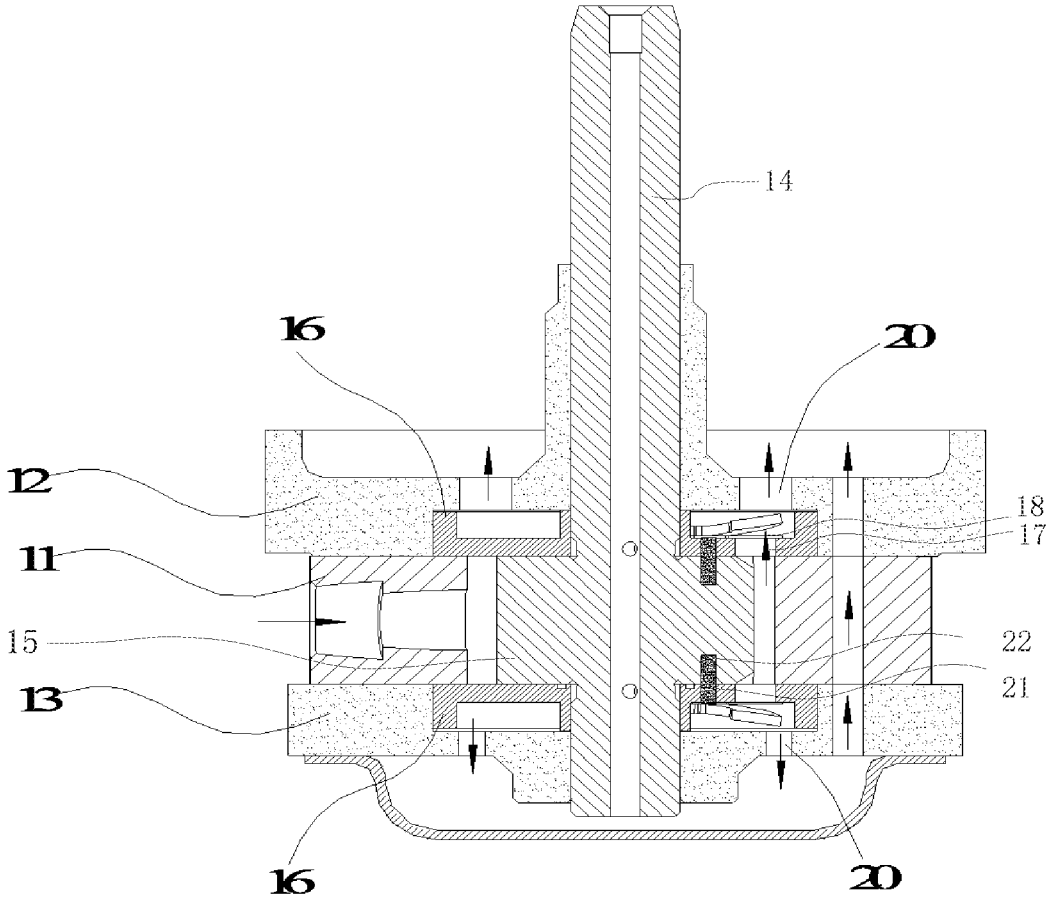
FIG. 5 is a cross-sectional view of the compressor in the second embodiment of the present invention.
Figure 6:
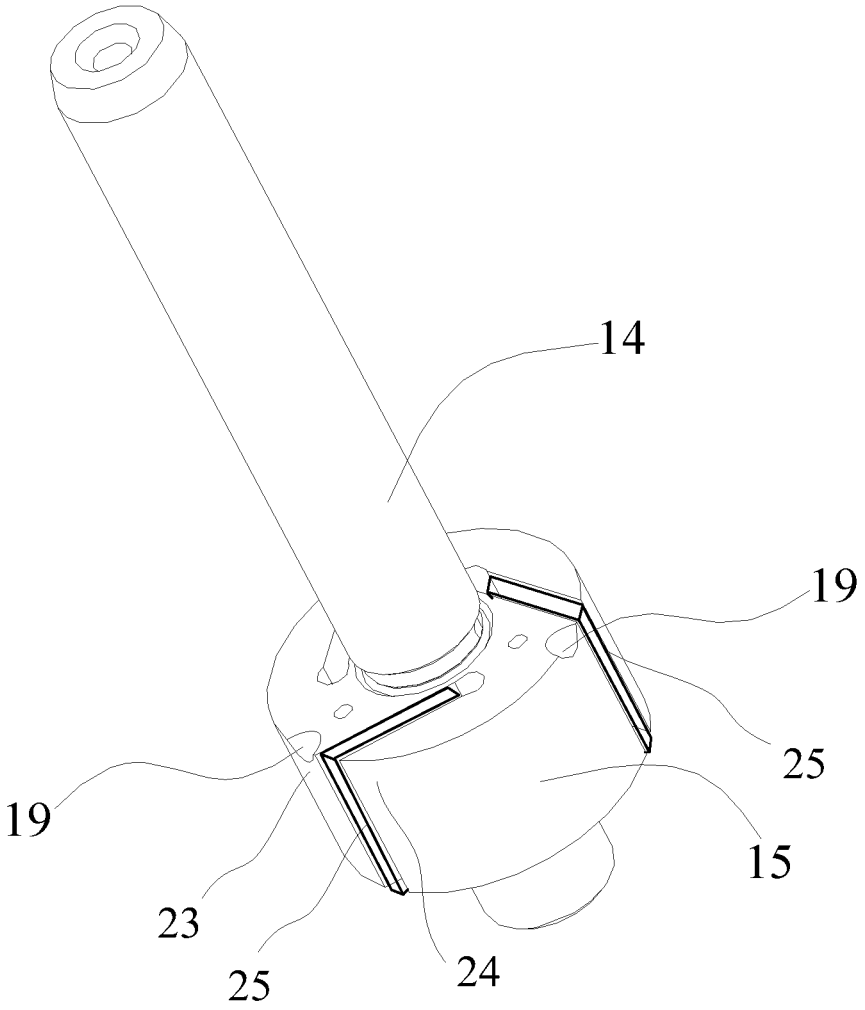

In this embodiment, a rotary plate 16 is provided between the sliding vane mounting portion 15 and at least one of the upper flange 12 and the lower flange 13. For example, as shown in FIG. 3, a rotary plate 16 is provided between the upper flange 12 and the sliding vane mounting portion 15. Or, as shown in FIG. 5, a rotary plate 16 is provided between the upper flange 12 and the sliding vane mounting portion 15, and another rotary plate 16 is provided between the lower flange 13 and the sliding vane mounting portion 15. Alternatively, a rotary plate 16 is only provided between the lower flange 13 and the sliding vane mounting portion 15.

The rotary plate 16 is fixedly connected with the main shaft 14, which enables the rotary plate 16 to rotate synchronously with the main shaft 14. In addition, in this embodiment, the rotary plate 16 is provided with exhaust openings 17 which communicate one-to-one with the exhaust side 23 of each sliding vane 25, and is provided with an exhaust valve 18 which controls the opening and closing of the exhaust opening 17. When the pressure of the compressed gas inside the compression cavity reaches the preset pressure, the exhaust valve 18 opens, and the compressed gas is discharged through the exhaust opening 17.

For example, in this embodiment, the sliding vane mounting portion 15 is provided with three sliding vanes 25; the rotary plate 16 is correspondingly provided with three exhaust openings 17; and the three exhaust ports 17 communicate one-to-one with the exhaust side 23 of each of the three sliding vanes 25. Certainly, in other embodiments, the number of sliding vanes 25 and exhaust ports 17 provided may be a different number than three as previously described above.

When the compressor operates, and when the pressure of the refrigerant in the compression cavity reaches the set pressure, the exhaust valve 18 corresponding to the compression cavity opens, and the high-pressure refrigerant is discharged through the exhaust opening 17.

In this way, when the main shaft 14 rotates for one cycle, each compression cavity fulfills one exhaust process, and each compression cavity is correspondingly provided with one exhaust opening 17 and one exhaust valve 18, therefore, each exhaust valve 18 only needs to open and close once when the main shaft 14 rotates for one cycle, thereby avoiding the problem that the exhaust valve 18 is prone to fatigue damages. Moreover, the time required for the exhaust valve to open and close may be negligible, thereby increasing the operating frequency of the compressor effectively and increasing the maximum refrigerating capacity of the compressor.

In order to increase the exhaust area of the cylinder 11 and reduce the energy loss caused by gas discharging, in the preferred solution of the embodiment, the sliding vane mounting portion 15 is provided with a vent 19 which is configured to connect the exhaust side 23 of the sliding vane 25 to the exhaust opening 17 of the rotary plate 16. In this way, the vent 19 can assist in discharging gas, thereby increasing the exhaust area of the cylinder 11 and reducing the resistance for discharging gas.

In this embodiment, the rotary plate 16 is connected to the sliding vane mounting portion 15 through a connecting member 22 such as a rivet, a pin, or a screw, etc. Specifically, a connecting opening 21 is disposed on the rotary plate 16 at a position corresponding to the sliding vane mounting portion 15, and the rotary plate 16 is fixed on the sliding vane mounting portion 15 through the connecting member 22 such as the rivet, the pin, or the screw, etc., which is inserted and mounted in the connecting opening 21.

Alternatively, in this embodiment, the rotary plate 16 may be fixedly connected to the sliding vane mounting portion 15 by other means, such as welding, casting connection and so on.

In this embodiment, the exhaust opening 17 in the rotary plate 16 communicates with the outside through the exhaust passage 20 disposed in the upper flange 12 or in the lower flange 13. Further, the sum of the cross-sectional areas of all exhaust passages 20 is larger than the sum of the cross-sectional areas of all exhaust openings 17, which can further reduce the resistance for discharging gas and the power consumption of the compressor.

In a preferred scheme of the present embodiment, specifically, the vent 19 disposed on the sliding vane mounting portion 15 is a chamfered structure, which is disposed at an edge of the sliding vane mounting portion 15 and adjacent to the exhaust side 23 of each sliding vane 25.

When the vent 19 is processed, simply a processing tool is needed to cut off a portion at the edge of the sliding vane mounting portion 15 directly, to form the chamfered structure, which facilitates processing. In an embodiment, the chamfered surface of the chamfered structure is a curved surface. In this way, the side wall of the vent 19 is relatively rounded and smooth so as to facilitate the gas circulation.

The embodiment also provides a compressor having an exhaust structure that is described in the above embodiments. In this way, the compressor provided in this embodiment can avoid the problem that the valve plate is prone to fatigue damages, and can increase the operating frequency of the compressor and the maximum refrigerating capacity of the compressor. The beneficial effects of the processor can be derived in a similar way as the beneficial effects achieved by the exhaust structure mentioned above, and therefore it will not be repeated herein.

The description of the embodiments disclosed above enables those skilled in the art to implement or use the present invention. Various modifications to these embodiments are readily apparent to those skilled in the art, and the general principles defined herein may be applied to other embodiments without departing from the spirits or the scope of the invention. Thus, the present invention will not be limited to the embodiments illustrated herein, but conform to the widest scope consistent with the principles and novel features disclosed herein.

What is claimed is:

1. A compressor, comprising:

a cylinder, an upper flange and a lower flange which are disposed on an upper side and a lower side of the cylinder respectively, and a main shaft having a sliding vane mounting portion;

wherein, the sliding vane mounting portion of the main shaft is provided with at least two sliding vanes; a side of each sliding vane is a gas suction side, and another side of each sliding vane is an exhaust side;

two rotary plates are provided; one rotary plate is provided between the sliding vane mounting portion and the upper flange, and another rotary plate is provided between the sliding vane mounting portion and the lower flange;

each of the rotary plates is fixedly connected with the main shaft and provided with exhaust openings in one-to-one correspondence with the exhaust sides of the sliding vanes, and is provided with exhaust valves which control opening and closing of the exhaust openings respectively;

the upper flange and the lower flange are both provided with exhaust passages corresponding to the exhaust openings of each rotary plate.

2. The compressor according to claim 1, wherein, the sliding vane mounting portion is provided with a vent, which is configured to increase an area of communication between the exhaust side of the sliding vane and the exhaust opening of the rotary plate.

3. The compressor according to claim 2, wherein, the vent is a chamfered structure, which is disposed at an edge of the sliding vane mounting portion and adjacent to the exhaust side of each sliding vane.

4. The compressor according to claim 3, wherein, a chamfered surface of the chamfered structure is a curved surface.

5. The compressor according to claim 1, wherein, a connecting opening is disposed on each rotary plate at a position corresponding to the sliding vane mounting portion; and each rotary plate is fixed on the sliding vane mounting portion through a connecting member which is inserted and mounted in the connecting opening.

6. The compressor according to claim 1, wherein, a sum of cross-sectional areas of all exhaust passages is greater than a sum of cross-sectional areas of all exhaust openings.

* * * * *